US010865587B2

(12) United States Patent
Russell et al.

(10) Patent No.: US 10,865,587 B2
(45) Date of Patent: Dec. 15, 2020

(54) DEADBOLT SECURING ASSEMBLY

(71) Applicants: Joseph Russell, North York (CA); Valerie Russell, North York (CA)

(72) Inventors: Joseph Russell, North York (CA); Valerie Russell, North York (CA)

( * ) Notice: Subject to any disclaimer, the term of this patent is extended or adjusted under 35 U.S.C. 154(b) by 253 days.

(21) Appl. No.: 16/224,318

(22) Filed: Dec. 18, 2018

(65) Prior Publication Data

US 2020/0190860 A1 Jun. 18, 2020

(51) Int. Cl.

| | |
|---|---|
| ***E05B 63/00*** | (2006.01) |
| ***E05B 13/04*** | (2006.01) |
| ***E05B 13/10*** | (2006.01) |
| ***E05B 1/00*** | (2006.01) |

(52) U.S. Cl.

CPC ..... *E05B 63/0013* (2013.01); *E05B 1/003* (2013.01); *E05B 13/108* (2013.01)

(58) Field of Classification Search

CPC .... E05B 63/0013; E05B 13/108; E05B 1/003; E05B 13/04; E05B 13/00

USPC ..... 70/202, 211, 212, 416, 429, 430; 292/258, 288–298, 359

See application file for complete search history.

(56) References Cited

U.S. PATENT DOCUMENTS 1,700,045 A * 1/1929 Hampton ..... E05B 13/04 70/430
1,846,421 A * 2/1932 Guerrant ..... E05B 13/04 70/430
2,151,587 A * 3/1939 Cassileth ..... E05C 19/18 292/288
2,515,364 A * 7/1950 Weaver ..... E05B 13/002 292/359
2,517,480 A * 8/1950 Hagan ..... E05B 13/04 70/429
3,423,974 A * 1/1969 Bernsley ..... E05B 13/002 70/416
3,585,827 A * 6/1971 Dominguez ..... E05B 13/04 70/416
3,862,556 A * 1/1975 Moses ..... E05B 13/04 70/416
3,933,014 A * 1/1976 Moses ..... E05B 13/04 70/416
4,279,137 A * 7/1981 Cook ..... E05B 13/04 70/416
4,715,200 A * 12/1987 Katsaros ..... E05B 13/04 70/211
5,000,498 A * 3/1991 Upchurch ..... E05B 13/04 292/256.67

(Continued)

*Primary Examiner* — Lloyd A Gall

(57) ABSTRACT

A deadbolt securing assembly includes a restraint that has a rounded portion being positionable around a stem of a doorknob on a door. The restraint has a rhombus portion that is spaced from the rounded portion. The rhombus portion is positionable around a deadbolt knob on the door when the rounded portion is positioned around the stem of the doorknob. Thus, the restraint inhibits the deadbolt knob from being rotated when the restraint is positioned between the doorknob and the deadbolt knob. In this way the restraint inhibits the door from being unlocked with a key. A doorknob pad is coupled to the rounded portion of the restraint to frictionally engage the stem of the doorknob. A deadbolt pad is coupled to the rhombus portion of the restraint to frictionally engage the deadbolt knob.

11 Claims, 8 Drawing Sheets

(56) References Cited

U.S. PATENT DOCUMENTS

| | | | | | |
|---|---|---|---|---|---|
| 5,007,263 | A * | 4/1991 | Taylor | E05B 13/002 | 292/288 |
| 5,035,128 | A * | 7/1991 | Ridgway | E05B 13/04 | 70/211 |
| 5,052,202 | A * | 10/1991 | Murphy | E05B 13/04 | 70/211 |
| 5,517,838 | A * | 5/1996 | Moore | E05B 13/002 | 24/16 PB |
| D397,025 | S | 8/1998 | Kosi | | |
| 6,182,485 | B1 * | 2/2001 | Moore | E05B 13/002 | 292/258 |
| 6,993,944 | B2 | 2/2006 | Hicks | | |
| 7,144,052 | B1 * | 12/2006 | Kent | E05B 13/04 | 292/288 |
| 7,216,903 | B1 | 5/2007 | Kent | | |
| 7,418,847 | B2 * | 9/2008 | Kosi | E05B 13/04 | 292/288 |
| 7,805,967 | B1 * | 10/2010 | Agozzino | E05B 13/04 | 70/211 |
| 7,837,242 | B1 * | 11/2010 | Moscarello | E05B 13/04 | 292/288 |
| 8,443,640 | B2 * | 5/2013 | Davis | E05B 13/04 | 70/416 |
| 9,487,975 | B2 | 11/2016 | Daniels | | |
| 9,644,395 | B2 * | 5/2017 | Strand | E05C 19/18 | |
| 2005/0193787 | A1 | 9/2005 | Davis | | |
| 2007/0107479 | A1 | 5/2007 | Robertson | | |
| 2008/0042451 | A1 * | 2/2008 | Moore | E05C 19/18 | 292/288 |
| 2012/0222459 | A1 * | 9/2012 | Glazar | E05B 13/04 | 70/91 |
| 2014/0165680 | A1 * | 6/2014 | Noel | E05B 13/04 | 70/431 |

* cited by examiner

DEADBOLT SECURING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to securing devices and more particularly pertains to a new securing device for inhibiting a deadbolt from being unlocked with a key.

BRIEF SUMMARY OF THE INVENTION

An embodiment of the disclosure meets the needs presented above by generally comprising a restraint that has a rounded portion being positionable around a stem of a doorknob on a door. The restraint has a rhombus portion that is spaced from the rounded portion. The rhombus portion is positionable around a deadbolt knob on the door when the rounded portion is positioned around the stem of the doorknob. Thus, the restraint inhibits the deadbolt knob from being rotated when the restraint is positioned between the doorknob and the deadbolt knob. In this way the restraint inhibits the door from being unlocked with a key. A doorknob pad is coupled to the rounded portion of the restraint to frictionally engage the stem of the doorknob. A deadbolt pad is coupled to the rhombus portion of the restraint to frictionally engage the deadbolt knob.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
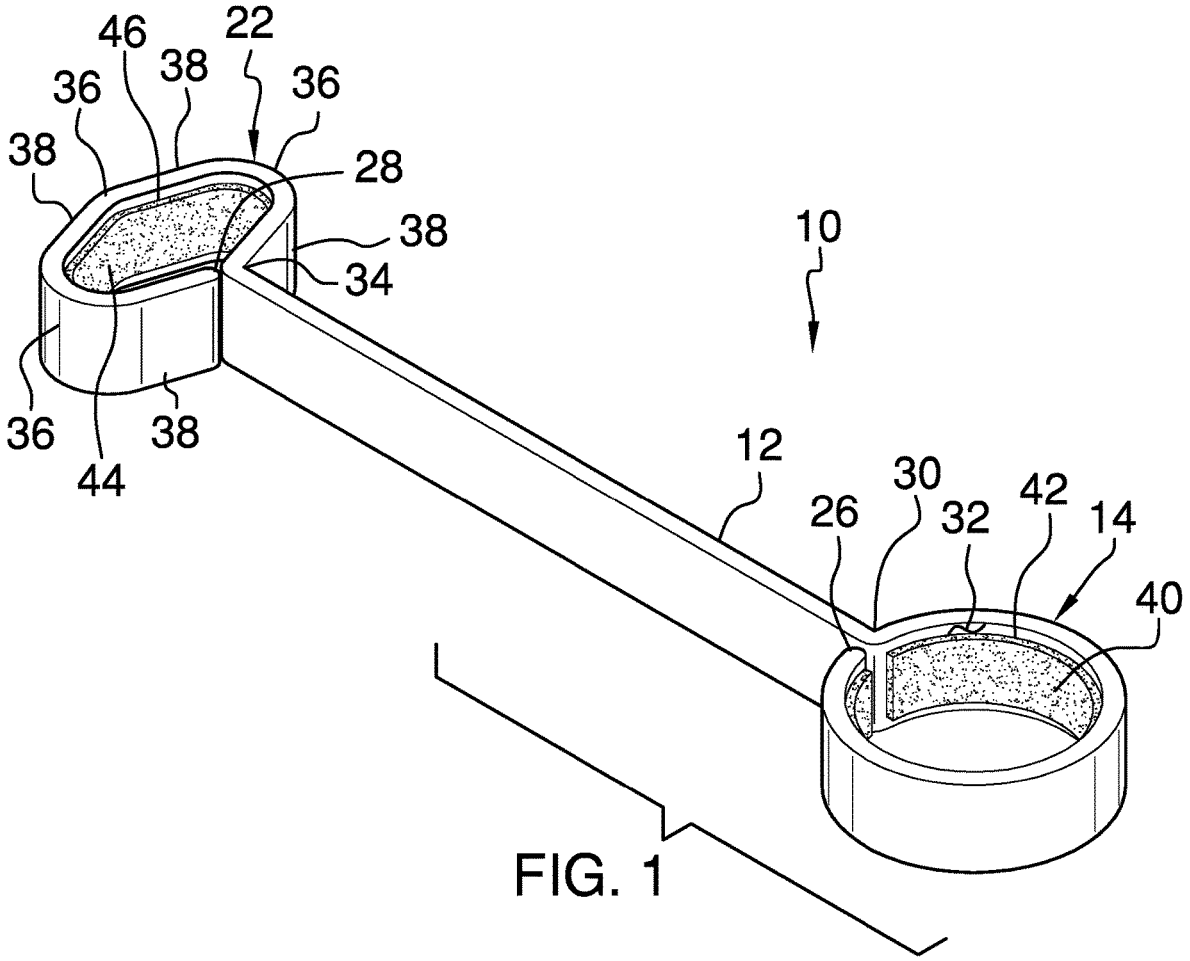
FIG. 1 is a front perspective view of a deadbolt securing assembly according to an embodiment of the disclosure.
Figure 2:
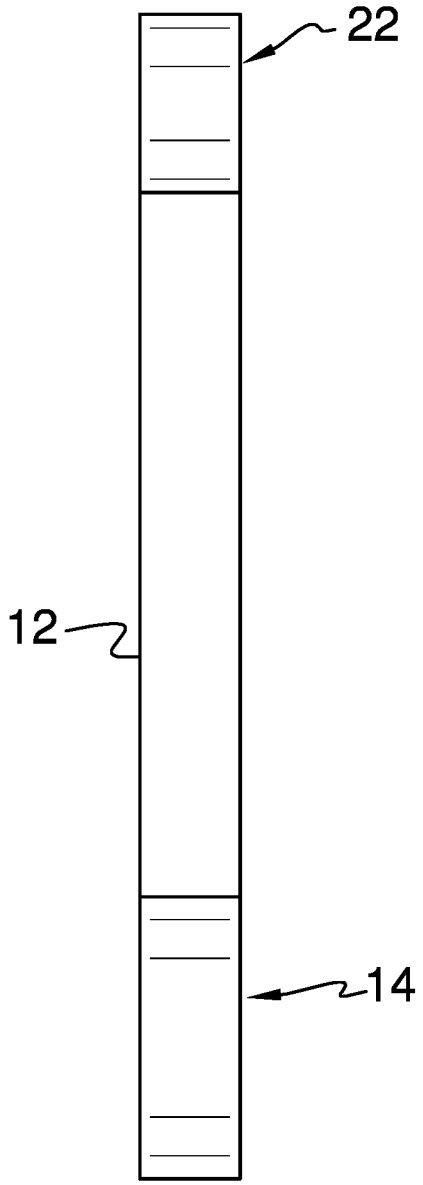
FIG. 2 is a right side view of an embodiment of the disclosure.
Figure 3:
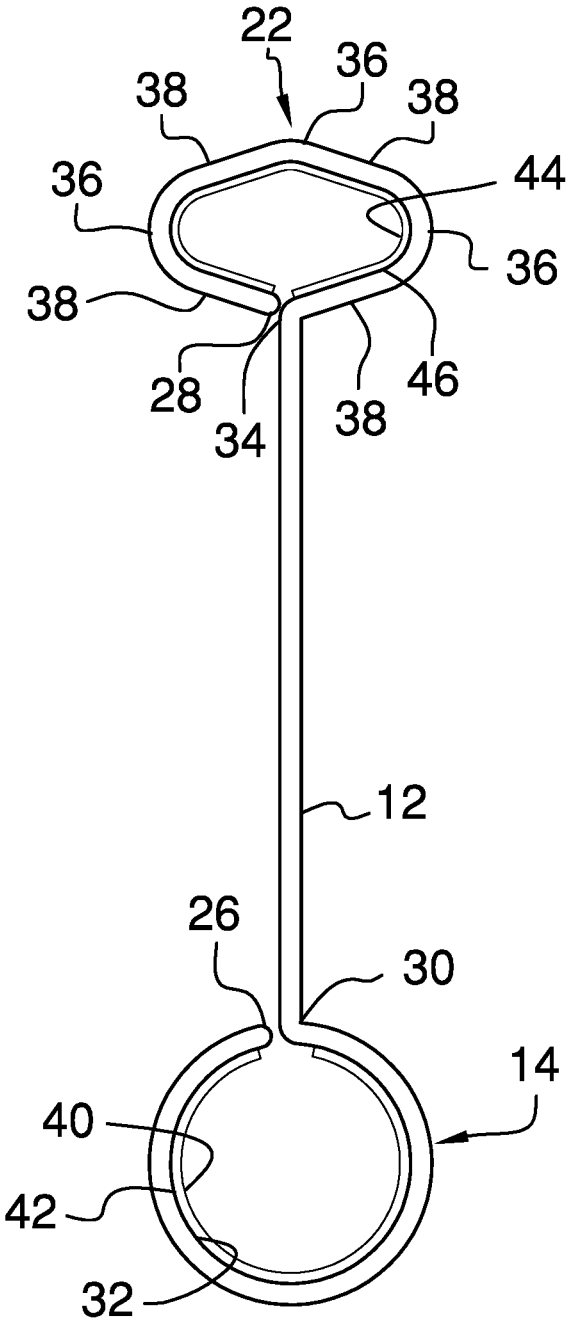
FIG. 3 is a front view of an embodiment of the disclosure.
Figure 4:
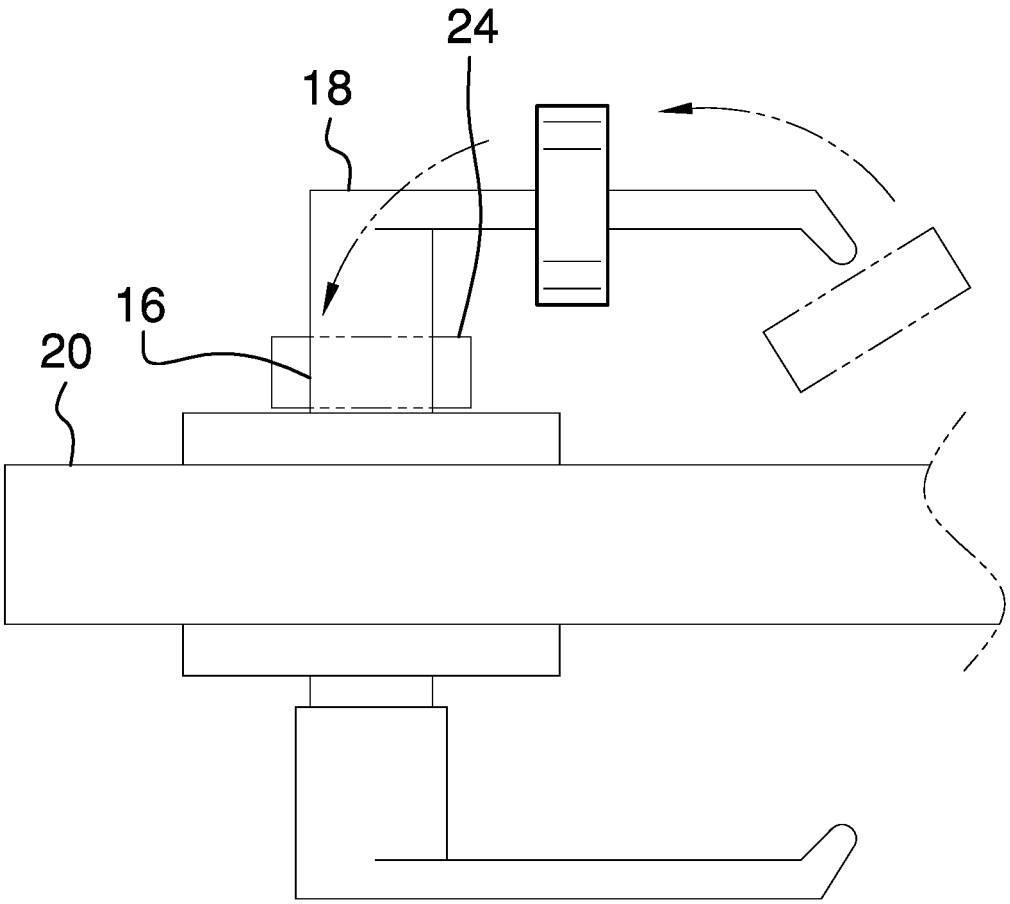
FIG. 4 is a top perspective in-use view of an embodiment of the disclosure.
Figure 5:
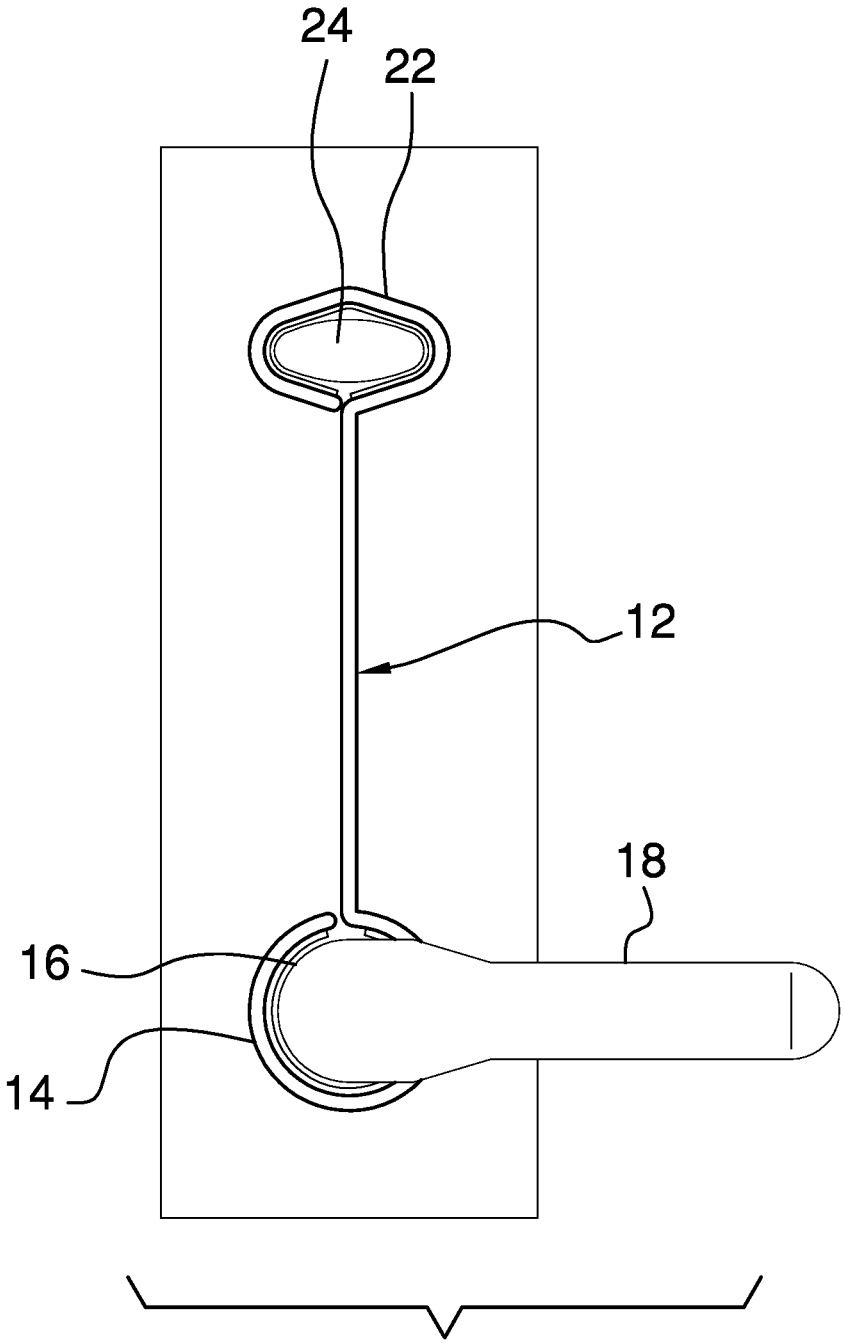
FIG. 5 is a front perspective in-use view of an embodiment of the disclosure.

With reference now to the drawings, and in particular to FIGS. 1 through 9 thereof, a new securing device embodying the principles and concepts of an embodiment of the disclosure and generally designated by the reference numeral 10 will be described.

As best illustrated in FIGS. 1 through 9, the deadbolt securing assembly 10 generally comprises a restraint 12 that has a rounded portion 14 being positionable around a stem 16 of a doorknob 18 on a door 20. The door 20 may be an entrance door to a house, an apartment or any other type of residence. Additionally, the restraint 12 has a rhombus portion 22 that is spaced from the rounded portion 14. The rhombus portion 22 is positoinable around a deadbolt knob 24 on the door 20 when the rounded portion 14 is positioned around the stem 16 of the doorknob 18. In this way the restraint 12 inhibits the deadbolt knob 24 from being rotated when the restraint 12 is positioned between the doorknob 18 and the deadbolt knob 24. Thus, the restraint 12 inhibits the door 20 from being unlocked with a key.

The restraint 12 has a first end 26 and a second end 28, and the restraint 12 is elongated between the first 26 and second 28 ends. The restraint 12 has a first bend 30 thereon that is positioned closer to the first end 26 than the second end 28. The restraint 12 is curved between the first bend 30 and the first end 26 to define the rounded portion 14 of the restraint 12. Additionally, the first end 26 is aligned with and is spaced from the first bend 30, and the rounded portion 14 has an inwardly facing surface 32.

The restraint 12 has a second bend 34 thereon that is positioned closer to the second end 28 than the first bend 30. The restraint 12 has a sequence of curves 36 thereon that are positioned between the second bend 34 and the second end 28. The curves 36 are spaced apart from each other and are distributed between the second bend 34 and the second end 28. The curves 36 thusly define a plurality of intersecting sides 38 of the rhombus portion 22 of the restraint 12. Additionally, the rhombus portion 22 is elongated along a longitudinal axis that is oriented perpendicular to a longitudinal axis of the restraint 12. The second end 28 of the restraint 12 is aligned with and is spaced from the second bend 34, and the rhombus portion 22 has an inwardly facing surface 39.

A doorknob pad 40 is coupled to the rounded portion 14 of the restraint 12. The doorknob pad 40 frictionally engages the stem 16 of the doorknob 18 when the rounded portion 14 is positioned therearound. The doorknob pad 40 has a first surface 42 and the first surface 42 is coupled to the inwardly facing surface 32 of the rounded portion 14. Additionally, the doorknob pad 40 extends between the first bend 30 and the first end 26 of the restraint 12.

A deadbolt pad 44 is coupled to the rhombus portion 22 of the restraint 12. The deadbolt pad 44 frictionally engages the deadbolt knob 24 when the rhombus portion 22 is positioned therearound. The deadbolt pad 44 has a primary surface 46 and the primary surface 46 is coupled to the inwardly facing surface 39 of the rhombus portion 22. Additionally, the deadbolt pad 44 extending between the second bend 34 and the second end 28 of the restraint 12.

Figure 6:
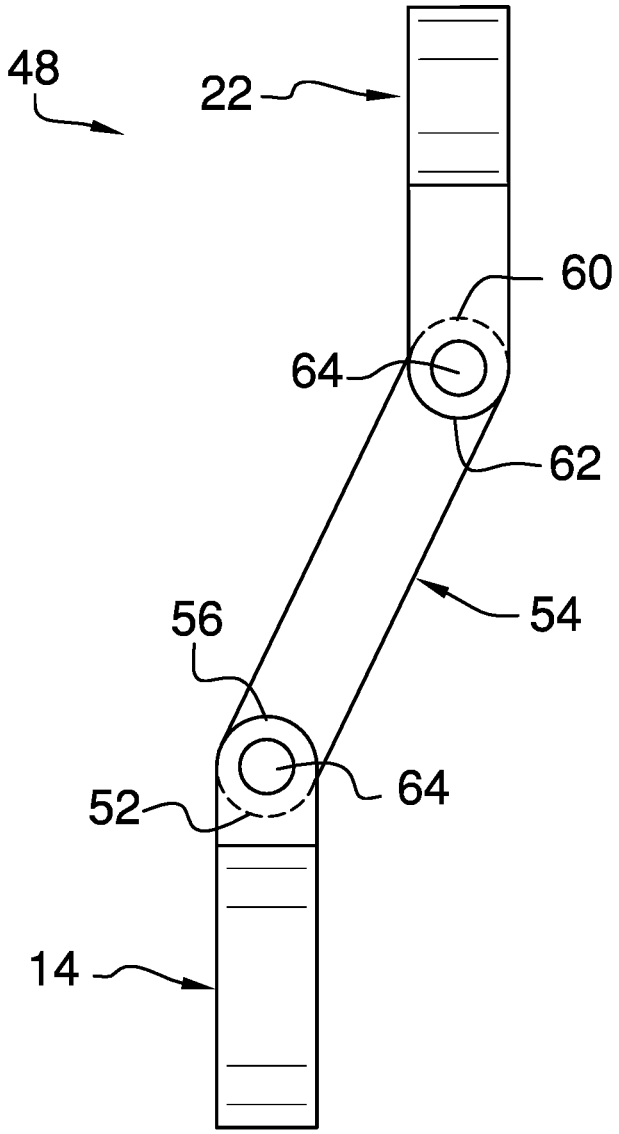
FIG. 6 is a right side view of an alternative embodiment of the disclosure.
Figure 7:
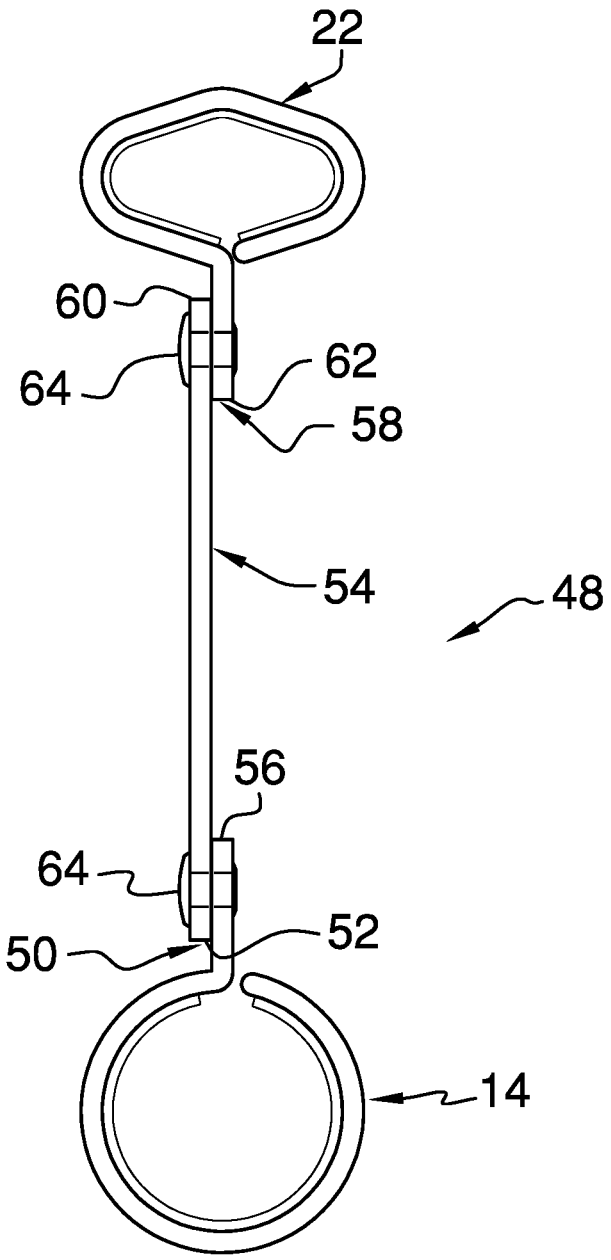
FIG. 7 is a front view of an alternative embodiment of the disclosure.
Figure 9:
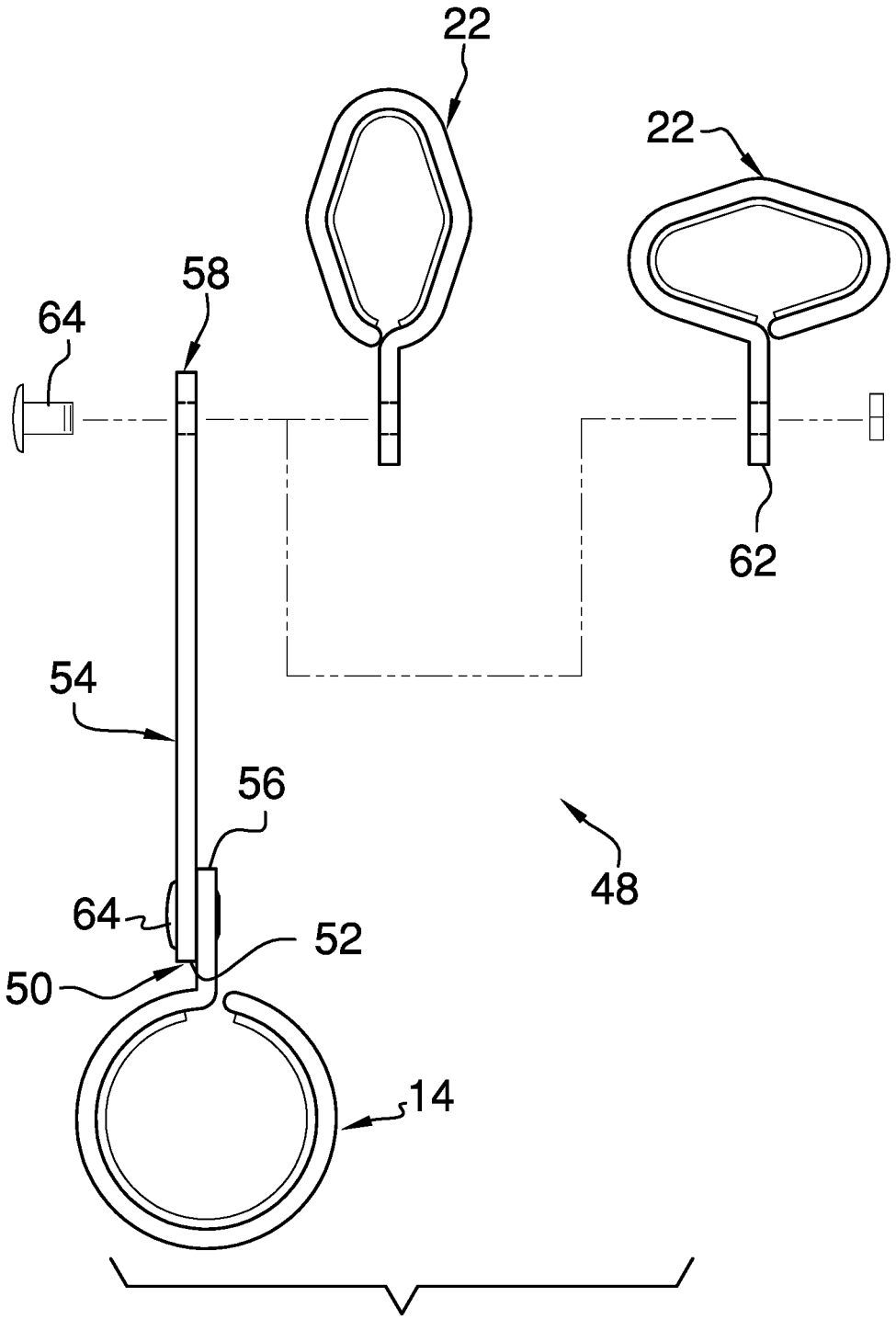
FIG. 9 is an exploded perspective view of an alternative embodiment of the disclosure.

In an alternative embodiment 48 as shown in FIGS. 6, 7 and 9, the restraint 12 has a first break 50 therein that is spaced from the first bend 30 to define a primary end 52 of a central portion 54 of the restraint 12 and a primary end 56 of the rounded portion 14 of the restraint 12. Continuing in the alternative embodiment 48, the restraint 12 has a second break 58 therein that is spaced from the second bend 34 to define a secondary end 60 of the central portion 54 and a secondary end 62 of the rhombus portion 22.

A pair of fasteners 64, each comprising a nut and a bolt or the like, each extends through the central portion 54 and engages a respective one of the rounded 14 and rhombus 22 portions. Thus, the primary end 56 of the rounded portion 14 is pivotally coupled to the primary end 52 of the central portion 54 and the secondary end 62 of the rhombus portion 22 is pivotally coupled to the secondary end 60 of the central portion 54. Moreover, each of the rounded 14 and rhombus 22 portions is positoinable at a selectable angle with respect to the central portion 54. In this way the restraint 12 can accommodate a doorknob 18 that is offset from the deadbolt knob 24. As depicted in FIG. 9, a pair of the rhombus portions 22 may be provided, and each of the rhombus portions 22 may be elongated along a respective vertical or horizontal axis.

Figure 8:
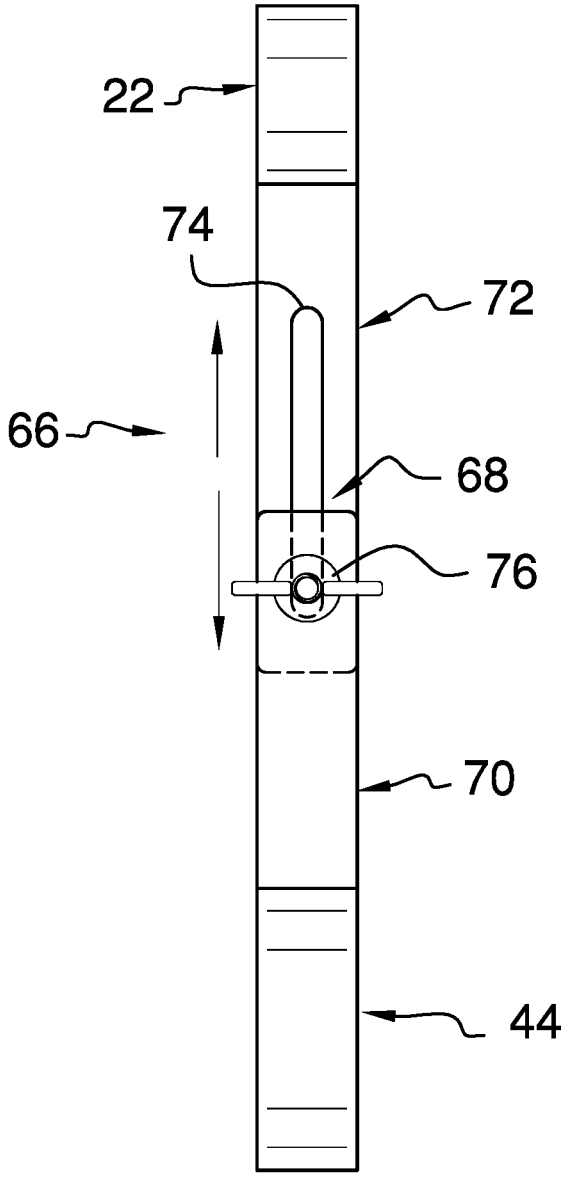
FIG. 8 is a right side view of an alternative embodiment of the disclosure.

In an alternative embodiment 66 as shown in FIG. 8, the restraint 12 has a break 68 therein that is centrally positioned between the first 30 and second 34 bends. The break 68 defines a first half 70 that has the rounded portion 14 associated therewith and a second half 72 of that has the rhombus portion 22 associated therewith. The second half 72 has a slot 74 extending therethrough and the slot 74 extends between the break 68 and the rounded portion 14. A fastener 76, such as a nut and bolt or the like, extends through the second half 72 and engages the slot 74. Moreover, the fastener 76 is positionable at a selected point along the slot 74 such that the restraint 12 has a slidably adjustable length.

In use, the rounded portion 14 is positioned around the stem 16 of the doorknob 18. The restraint 12 is spun on the doorknob 18 to facilitate the rhombus portion 22 to be positioned around the deadbolt knob 24. Thus, the restraint 12 extends between the doorknob 18 and the deadbolt knob 24 thereby inhibiting the deadbolt knob 24 from rotating. In this way the restraint 12 inhibits the deadbolt in the door 20 from being unlocked with a key. Thus, a person in a room in which the door 20 is positioned can rest assured that no one can enter the room with a key.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A deadbolt securing assembly being configured to be coupled between a doorknob and a deadbolt thereby restricting rotation of the deadbolt, said assembly comprising:

a restraint having a rounded portion being positionable around a stem of a doorknob on a door, said restraint having a rhombus portion being spaced from said rounded portion, said rhombus portion being positionable around a deadbolt knob on the door when said rounded portion is positioned around the stem of the doorknob, said restraint inhibiting the deadbolt knob from being rotated when said restraint is positioned between the doorknob and the deadbolt knob wherein said restraint is configured to inhibit the door from being unlocked with a key;

a doorknob pad being coupled to said rounded portion of said restraint wherein said doorknob pad is configured to frictionally engage the stem of the doorknob when said rounded portion is positioned therearound; and a deadbolt pad being coupled to said rhombus portion of said restraint wherein said deadbolt pad is configured to frictionally engage the deadbolt knob when said rhombus portion is positioned therearound.

2. The assembly according to claim 1, wherein said restraint has a first end and a second end, said restraint being elongated between said first and second ends, said restraint having a first bend thereon being positioned closer to said first end than said second end, said restraint having a second bend thereon being positioned closer to said second end than said first bend.

3. The assembly according to claim 2, wherein said restraint is curved between said first bend and said first end to define said rounded portion of said restraint having said first end being aligned with and being spaced from said first bend, said rounded portion having an inwardly facing surface.

4. The assembly according to claim 2, wherein said restraint has a sequence of curves thereon being positioned between said second bend and said second end, said curves being spaced apart from each other and being distributed between said second bend and said second end to define a plurality of intersecting sides of said rhombus portion of said restraint, said rhombus portion being elongated along a longitudinal axis being oriented perpendicular to a longitudinal axis of said restraint having said second end of said restraint being aligned with and being spaced from said second bend, said rhombus portion having an inwardly facing surface.

5. The assembly according to claim 3, wherein said doorknob pad has a first surface, said first surface being coupled to said inwardly facing surface of said rounded portion, said doorknob pad extending between said first bend and said first end of said restraint.

6. The assembly according to claim 4, wherein said deadbolt pad has a primary surface, said primary surface being positioned on said inwardly facing surface of said rhombus portion, said deadbolt pad extending between said second bend and said second end of said restraint.

7. A deadbolt securing assembly being configured to be coupled between a doorknob and a deadbolt thereby restricting rotation of the deadbolt, said assembly comprising:

a restraint having a rounded portion being positionable around a stem of a doorknob on a door, said restraint having a rhombus portion being spaced from said rounded portion, said rhombus portion being positionable around a deadbolt knob on the door when said rounded portion is positioned around the stem of the doorknob, said restraint inhibiting the deadbolt knob from being rotated when said restraint is positioned between the doorknob and the deadbolt knob wherein said restraint is configured to inhibit the door from being unlocked with a key, said restraint having a first end and a second end, said restraint being elongated between said first and second ends, said restraint having a first bend thereon being positioned closer to said first end than said second end, said restraint being curved between said first bend and said first end to define said rounded portion of said restraint having said first end being aligned with and being spaced from said first bend, said rounded portion having an inwardly facing surface, said restraint having a second bend thereon being positioned closer to said second end than said first bend, said restraint having a sequence of curves thereon being positioned between said second bend and said second end, said curves being spaced apart from each other and being distributed between said second bend and said second end to define a plurality of intersecting sides of said rhombus portion of said restraint, said rhombus portion being elongated along a longitudinal axis being oriented perpendicular to a longitudinal axis of said restraint having said second end of said restraint being aligned with and being spaced from said second bend, said rhombus portion having an inwardly facing surface;

a doorknob pad being coupled to said rounded portion of said restraint wherein said doorknob pad is configured to frictionally engage the stem of the doorknob when said rounded portion is positioned therearound, said doorknob pad having a first surface, said first surface being coupled to said inwardly facing surface of said rounded portion, said doorknob pad extending between said first bend and said first end of said restraint; and a deadbolt pad being coupled to said rhombus portion of said restraint wherein said deadbolt pad is configured to frictionally engage the deadbolt knob when said rhombus portion is positioned therearound, said deadbolt pad having a primary surface, said primary surface being coupled to said inwardly facing surface of said rhombus portion, said deadbolt pad extending between said second bend and said second end of said restraint.

8. The assembly according to claim 7, wherein:

said restraint has a first break therein being spaced from said first bend to define a primary end of a central portion of said restraint and a primary end of said rounded portion of said restraint; and said restraint has a second break therein being spaced from said second bend to define a secondary end of said central portion and a secondary end of said rhombus portion.

9. The assembly according to claim 8, further comprising a pair of fasteners, each of said fasteners extending through said central portion and engaging a respective one of said rounded and rhombus portions such that said primary end of said rounded portion is pivotally coupled to said primary end of said central portion and said secondary end of said rhombus portion is pivotally coupled to said secondary end of said central portion, each of said rounded and rhombus portions being positionable at a selectable angle with respect to said central portion wherein said restraint is configured to accommodate a doorknob that is offset from a deadbolt knob.

10. The assembly according to claim 7, wherein said restraint has a break therein being centrally positioned between said first and second bends to define a first half having said rounded portion being associated therewith and a second half having said rhombus portion being associated therewith, said second half having a slot extending therethrough, said slot extending between said break and said rounded portion.

11. The assembly according to claim 10, further comprising a fastener extending through said second half and engaging said slot, said fastener being positionable at a selected point along said slot such that said restraint has a slidably adjustable length.

* * * * *